United States Patent [19]

Saleh et al.

[11] Patent Number: 4,642,860

[45] Date of Patent: Feb. 17, 1987

[54] APPARATUS FOR LUBRICATING AND DISSIPATING HEAT FROM CHEEK PLATES OF A TEXTILE CRIMPING MECHANISM

[75] Inventors: Lotfy L. Saleh, Matthews; John A. Turton, Charlotte; Steven L. Matthews, Salisbury, all of N.C.

[73] Assignee: Celanese Corporation, New York, N.Y.

[21] Appl. No.: 787,598

[22] Filed: Oct. 15, 1985

[51] Int. Cl.[4] ..... D02G 1/12

[52] U.S. Cl. ..... 28/269

[58] Field of Search ..... 28/263, 268, 269, 270

[56] References Cited

U.S. PATENT DOCUMENTS 3,220,083 11/1965 Crawford et al. ..... 28/269

3,618,183 11/1971 Funk et al. ..... 28/269

3,800,373 4/1974 Fleissner ..... 28/263 X 4,521,944 6/1985 Stockbridge ..... 28/269 X

*Primary Examiner*—Robert R. Mackey

*Attorney, Agent, or Firm*—Robert J. Blanke

[57] ABSTRACT

In the crimping of textile fibers, opposed rolls are rotated to force-feed the fibers through a nip defined by the rolls and into a stuffer box. A pair of cheek plates are pressed against the ends of the opposed rolls such that a front surface of each cheek plate engages ends of both rolls adjacent the nip to retain the fibers against lateral displacement from the nip. Atomized lubricating liquid is sprayed toward an inlet of the nip and against portions of the ends of the rolls approaching the nip, and against backsides of the cheek plates.

1 Claim, 3 Drawing Figures

APPARATUS FOR LUBRICATING AND DISSIPATING HEAT FROM CHEEK PLATES OF A TEXTILE CRIMPING MECHANISM

BACKGROUND AND OBJECTS OF THE INVENTION

The present invention relates to the crimping of textile fibers.

One conventional technique for crimping textile fibers, especially synthetic fibers, involves advancing the fibers, or tow, into a stuffer box which resists the rate of egress of the tow from the box. The tow is advanced into the box by means of a pair of motor-driven crimper rolls which define therebetween a nip through which the tow is advanced. In order to restrain the tow from wandering out of the intended travel path as the tow passes through the nip, a pair of cheek plates, or crimper disks, are positioned on opposite sides of the rolls. The cheek plates, which can be stationary or rotatably driven, include front faces which are pushed against the sides of the crimper rolls and are thus subject to considerable wear.

In order to reduce the rate of wear of stationary cheek plates, it has been heretofore proposed to lubricate the cheek plates by forcing a lubricating liquid through holes in the cheek plates (e.g., see Baken U.S. Pat. No. 3,662,439 issued May 16, 1972). A system such as that may provide for a lubricating of the front faces of the cheek plates, but does not materially alleviate other problems involved, such as heat build-ups occurring in the fibers and exterior portions of the cheek plates, and the wearing of the outer edge portions of the tow. Furthermore, the lubricant itself may tend to form unwanted deposits on the equipment. In addition, the need to conduct fluid through the holes in the cheek plates renders it difficult to employ such an arrangement in connection with cheek plates of the rotatable type.

It is, therefore, an object of the present invention to minimize or obviate problems of the type discussed above.

Another object is to minimize the wearing of cheek plates, of both the stationary and rotating types.

A further object is to maximize the cooling of the tow cheek plates.

An additional object is to prevent deposits from building up on the equipment.

Yet another object is to minimize wear of the outer edges of the tow.

SUMMARY OF THE INVENTION

These objects are achieved by the present invention which relates to the crimping of textile fibers. In a method aspect of the present invention, opposed rolls are rotated to force-feed the fibers through a nip defined by the rolls and into a stuffer box. A pair of cheek plates are pressed against the ends of the opposed rolls such that a front surface of each cheek plate engages ends of both rolls adjacent the nip to retain the fibers against lateral displacement of the nip. A lubricating liquid is atomized and is sprayed against an inlet of the nip, and against portions of the ends of the rolls approaching the nip, and against backsides of the cheek plates. The lubricating spray has the ability to increase cheek plate life eight fold or more and will minimize damage to the textile fiber or tow.

The present invention also relates to an apparatus which comprises a stuffer box, opposed motor-driven rotatable crimper rolls mounted in front of the stuffer box and defining the nip through which the fibers are force-fed into the stuffer box. A pair of cheek plates are disposed at opposite sides of the opposed rolls such that a front surface of each cheek plate is engageable with ends of both rolls adjacent the nip to retain the fibers against lateral displacement of the nip. A lubricating-/heat dissipating mechanism comprises atomizing sprayers disposed at both sides of the opposed rolls for spraying atomized liquid toward a region including an inlet of the nip and portions of the ends of the rolls approaching the nip, and backsides of the cheek plates.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
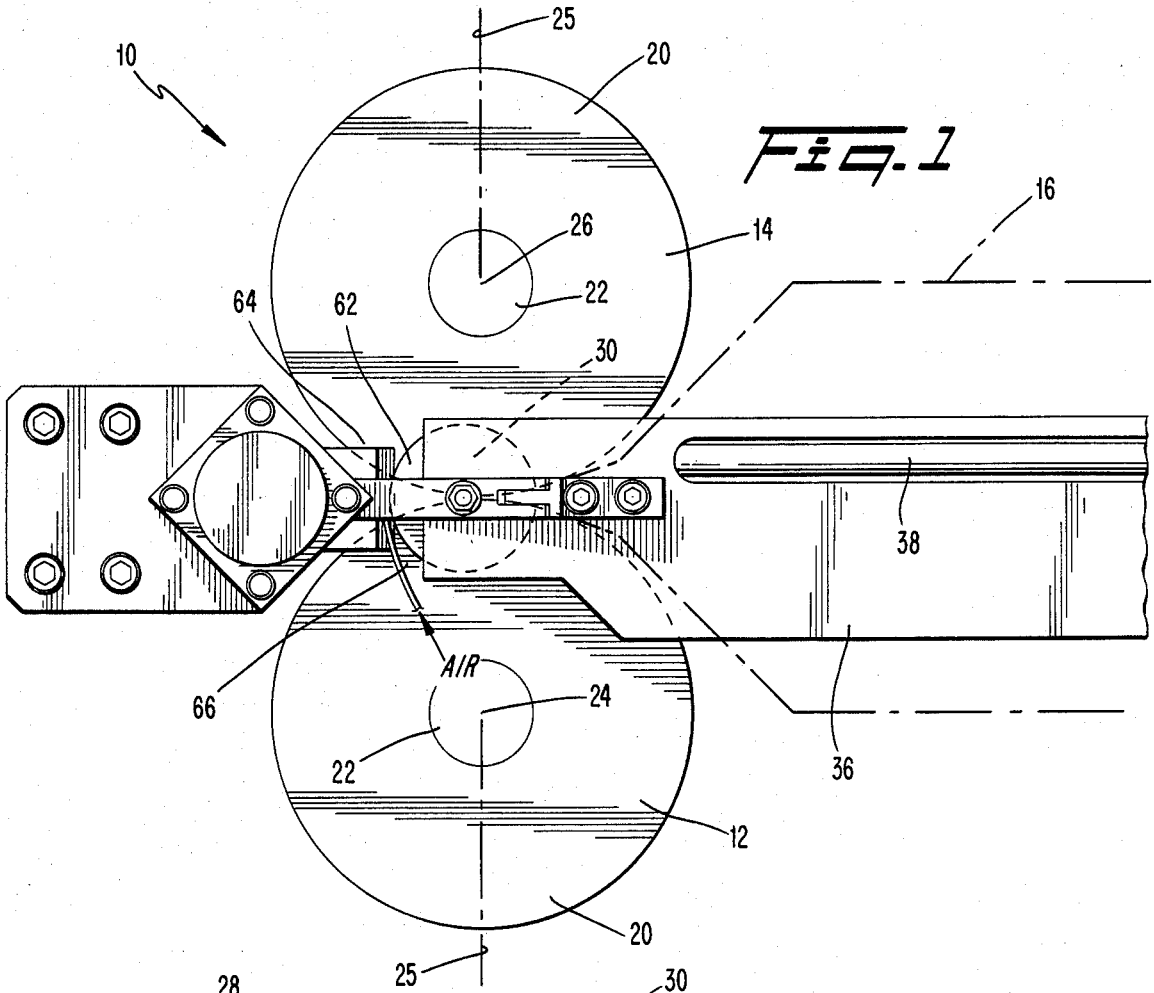
FIG. 1 is a side elevational view of a crimping mechanism according to the present invention, with a stuffer box depicted in phantom lines.

A crimper mechanism 10 is depicted in FIG. 1 which comprises a pair of motor-driven crimper rolls 12, 14 and a stuffer box 16 located downstream of a nip 18 defined between the rolls. Each roll comprises a stainless steel tire 20 mounted by shrink-fit on a center core 22. The rolls include parallel axes of rotation 24, 26 disposed in an imaginary common vertical plane 25, the rolls being adapted to force-feed a tow, or bundle of fibers, horizontally into the stuffer box 16 during a conventional crimping operation.

In order to prevent the tow from wandering from the nip laterally of the horizontal direction of tow travel 28, a pair of cheek plates or crimper plates 30 are positioned on opposite sides of the roll assembly 12, 14. The cheek plates 30, which can be formed of a phospherous/-bronze composition, for example, are pressed against the ends of the rolls 12, 14 such that a front face of each cheek plate bears against portions of both rolls in the vicinity of the nip 18.

The cheek plates are preferably of the power-driven type in that they are rotated about a coextensive axis 32 disposed parallel to the axes of rotation 24, 26 of the crimper rolls 12, 14. Preferably, the axis of rotation of the cheek plates is located slightly upstream (i.e., to the left in FIG. 1) relative to the imaginary vertical plane 25 and lies in a common horizontal plane with the nip 18.

Each cheek plate is mounted on a horizontal axle 34, the axle 34 being mounted in a fixed frame 36 for rotation about its own longitudinal axis 32 and for longitudinal sliding movement toward and away from the rolls 12, 14 along that axis 32. A drive shaft 38 carried by the frame is rotatably driven by a suitable motor (not shown) and is drivingly connected to the axle by means of a worm gear coupling in a conventional manner.

Thus, rotation of the drive shaft 38 produces rotation of the cheek plate 30 about the axis 32. The drive shaft 38 is mounted to accommodate a slight amount of longitudinal sliding movement of the axle 34 along the axis 32.

An end of the axle 34 opposite the cheek plate is connected to a link 40. One end of the link 40 is mounted to the frame 36 by a vertical pivot pin 42 and the other end is loosely mounted in a slot 44 disposed at one end of an intermediate link 46. The other end of the intermediate link 46 is pivotably attached to a piston rod 48 of a fluidactuated motor 50 which is supported on a fixed frame 52. It will be appreciated that extension and retraction of the rod 48 moves the cheek plate 30 toward and away from the crimper rolls 12, 14. A similar mechanism is provided for each of the cheek plates 30.

The apparatus as thus far described is conventional and is characteristic of a mechanism manufactured by the Neumag Corporation.

Figure 2:
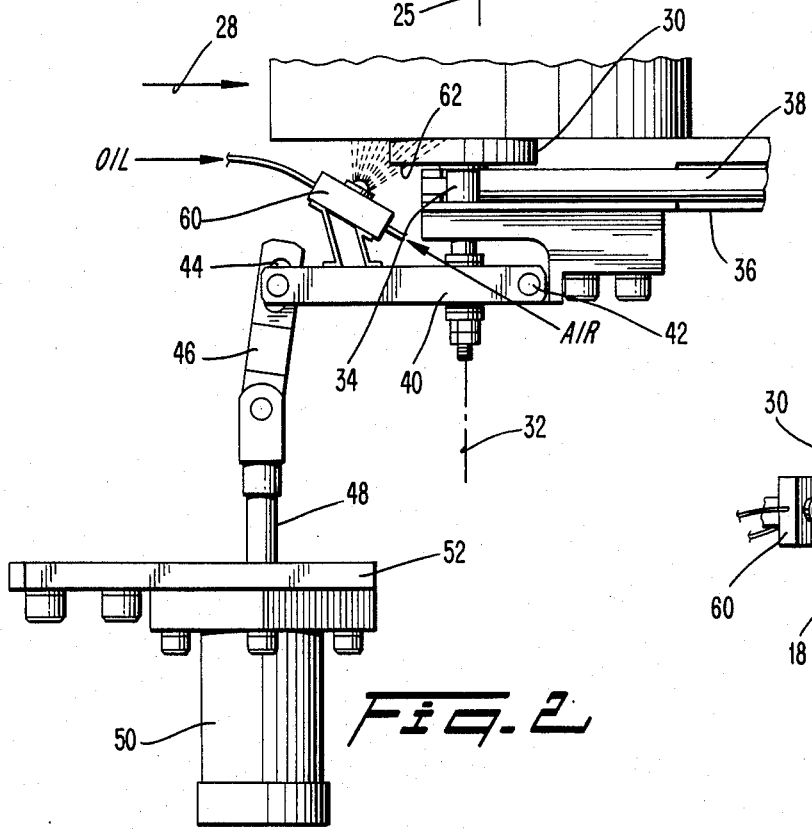
FIG. 2 is a bottom view of the apparatus depicted in FIG. 1.
Figure 3:
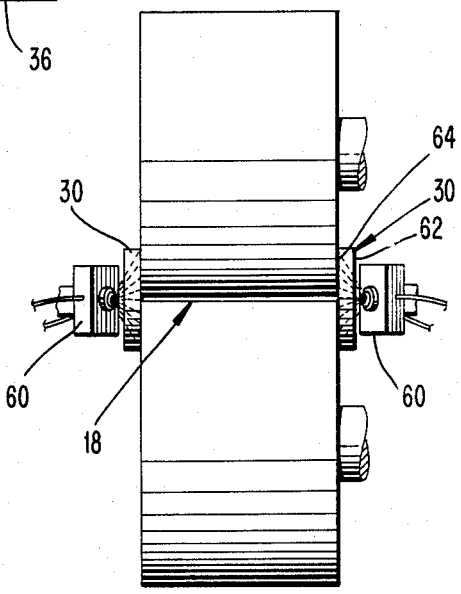
FIG. 3 is a somewhat schematic rear elevational view of the mechanism depicted in FIG. 1, facing an outlet of the nip between the opposed rolls, and with portions of the mechanism removed to provide a clear view of the atomizing sprayers.

In accordance with the present invention there is provided a lubrication/heat-dissipating mechanism in association with each cheek plate. That mechanism comprises an atomization nozzle 60 (FIGS. 2, 3) oriented to emit an atomized spray of a liquid lubricant such that the spray is aimed at a region which includes the backside 62 of the cheek plate 30, portions 64, 66 of both crimper rolls approaching the nip 18, and the tow entering the nip inlet. The nozzle can comprise any suitable atomizing sprayer such as that manufactured by Spraying System, Inc. of Wheaton, Illinois.

IN OPERATION, air and liquid lubricant are introduced separately into each nozzle and combined such that the lubricant is atomized, i.e., is emitted as a spray of minute droplets. That spray impinges upon (1) the incoming tow, (2) portions 64, 66 of the rolls 12, 14 which are converging at the cheek plate and nip, and (3) portions of the backsides 62 of the cheek plates 30. Lubricant applied to the tow and rolls is transferred to the front faces of the cheek plates as a result of contact therebetween to minimize any wear which would tend to occur as a result of frictional sliding action between the rolls and the front faces of the cheek plates. Also, wear of the outer edges of the tow will be minimized by the applied lubricant.

Importantly, the lubricant will dissipate heat from the tow, the rolls, and the front and back surfaces of the cheek plate to prevent the occurrence of excessive heat build-ups. The effectiveness of the heat dissipation action is greatly enhanced by the atomization of the lubricant. That is, liquid emitted in the form of small droplets is capable of swifter evaporation than liquid emitted in the form of solid streams; swifter evaporation translates into a more rapid removal of latent heat from the surface on which the droplets are disposed. Accordingly, the dissipation of heat is performed in a particularly effective manner in accordance with the atomization of lubricant.

It has also been found that the application of lubricant in the form of a high-pressure spray tends to perform a cleansing action. That is, the sprays tend to wash away any deposits which might otherwise collect on the surfaces of the rolls and cheek plates.

The application of lubricant by spray nozzles also eliminates any need for holding the cheek plates stationary, which need may be present in the case of a lubricant application system comprised of lubricant conduits formed directly in the cheek plates. That is, rotation of the cheek plates and the conduits formed therein may unduly complicate the delivery of liquid to the conduits. Thus, the present invention may be conveniently used in connection with cheek plates of the rotatable and stationary types.

Any suitable type of liquid lubricant can be employed, such as, for example, water and liquids commonly employed as textile finishes.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What we claim is:

1. A crimping apparatus for textile fibers, comprising:

a stuffer box, opposed motor-driven rotatable crimper rolls mounted in front of said stuffer box and defining a nip through which the fibers are force-fed into said stuffer box, a pair of cheek plates disposed at opposite sides of said opposed rolls such that a front surface of each cheek plate is engageable with ends of both said adjacent said nip to retain the fibers against lateral displacement from said nip, drive means for rotating said cheek plates about a common access disposed parallel to axis of rotation of said rolls, displacement means for moving said cheek plates toward and away from said ends of said rolls wherein said displacement means comprises a pair of motors and linkage interconnecting each motor with a respective cheek plate; and lubricating/heat dissipating means comprising atomizing sprayers disposed at both sides of said opposed rolls for spraying atomized liquid toward a region, including an inlet of said nip and portions of said ends of said rolls approaching said nip, and backsides of said cheek plates, said sprayers being mounted on said linkage.

* * * * *